US010264633B2

(12) United States Patent
Mercier et al.

(10) Patent No.: US 10,264,633 B2
(45) Date of Patent: Apr. 16, 2019

(54) OPTOELECTRONIC CIRCUIT WITH LIGHT-EMITTING DIODES

(71) Applicant: Aledia, Grenoble (FR)

(72) Inventors: Frédéric Mercier, Saint Nicolas de Macherin (FR); David Gras, Echirolles (FR); Nicolas Joubert, Grenoble (FR)

(73) Assignee: Aledia, Grenoble (FR)

( * ) Notice: Subject to any disclaimer, the term of this patent is extended or adjusted under 35 U.S.C. 154(b) by 0 days.

(21) Appl. No.: 15/750,172

(22) PCT Filed: Jul. 19, 2016

(86) PCT No.: PCT/FR2016/051843

§ 371 (c)(1),
(2) Date: Feb. 2, 2018

(87) PCT Pub. No.: WO2017/021610

PCT Pub. Date: Feb. 9, 2017

(65) Prior Publication Data

US 2018/0227992 A1 Aug. 9, 2018

(30) Foreign Application Priority Data

Aug. 3, 2015 (FR) ..... 15 57480

(51) Int. Cl.
*H05B 37/00* (2006.01)
*H05B 39/00* (2006.01)
*H05B 33/08* (2006.01)

(52) U.S. Cl.
CPC ..... *H05B 33/0815* (2013.01); *H05B 33/0824* (2013.01); *H05B 33/0809* (2013.01)

(58) Field of Classification Search
CPC .... H05B 41/34; H05B 33/0803; H05B 39/09; H05B 41/28; H05B 33/0809; H05B 37/02;

(Continued)

(56) References Cited

U.S. PATENT DOCUMENTS 8,569,956 B2 * 10/2013 Shteynberg ..... H05B 33/083 315/123
9,544,485 B2 * 1/2017 Conner ..... H04N 5/2354

(Continued)

FOREIGN PATENT DOCUMENTS

WO WO 2013/191806 A1 12/2013

OTHER PUBLICATIONS

Written Opinion for Application No. PCT/FR2016/051843 dated Oct. 25, 2016.

(Continued)

*Primary Examiner* — Minh D A

(74) *Attorney, Agent, or Firm* — Wolf, Greenfield & Sacks, P.C.

(57) ABSTRACT

An optoelectronic circuit for receiving a variable voltage containing alternating increasing and decreasing phases. The optoelectronic circuit includes assemblies of light-emitting diodes mounted in series; a current source connected to each assembly by a switch; for each switch, a first comparison module for comparing the current passing through the switch with a current threshold; a second comparison module for comparing a voltage representing the voltage at the terminals of the current source with a voltage threshold; and a control module connected to the first and second comparison modules and designed to control the opening and closing of the switches, during each increasing phase and each decreasing phase, according to signals supplied by the first and second comparison modules.

16 Claims, 6 Drawing Sheets

(58) Field of Classification Search
CPC ..... H05B 33/0842; H05B 41/295; H05B 41/2827; H05B 41/3925; H05B 41/04; H05B 41/234; H05B 33/0827; H05B 33/0821; H05B 37/029; H05B 37/0254; H05B 33/0818; Y02B 20/202; G09F 9/307; G09F 9/00; H01J 61/64; F21Y 2101/02
See application file for complete search history.

(56) References Cited

U.S. PATENT DOCUMENTS

| | | | | |
|---|---|---|---|---|
| 2009/0079355 | A1* | 3/2009 | Zhou ..... | H05B 33/0818 315/246 |
| 2012/0081009 | A1* | 4/2012 | Shteynberg ..... | H05B 33/083 315/122 |
| 2014/0139125 | A1 | 5/2014 | Lee | |
| 2015/0214976 | A1 | 7/2015 | De Marco et al. | |

OTHER PUBLICATIONS

International Search Report dated Oct. 25, 2016 in connection with Application No. PCT/FR2016/051843.

* cited by examiner

OPTOELECTRONIC CIRCUIT WITH LIGHT-EMITTING DIODES

CROSS-REFERENCE TO RELATED APPLICATIONS

This Application is the national phase of International Application No. PCT/FR2016/051843, filed Jul. 19, 2016, which claims priority to French Patent Application number 15/57480, filed Aug. 3, 2015, both of which applications are incorporated herein by reference to the maximum extent allowable.

BACKGROUND

The present description relates to an optoelectronic circuit, particularly to an optoelectronic circuit comprising light-emitting diodes.

DISCUSSION OF THE RELATED ART

It is desirable to be able to power an optoelectronic circuit comprising light-emitting diodes with an AC voltage, particularly a sinusoidal voltage, for example, the mains voltage.

FIG. 1 shows an example of an optoelectronic circuit 10 comprising input terminals $IN_1$ and $IN_2$ having an AC voltage $V_{IN}$ applied therebetween. Optoelectronic circuit 10 further comprises a rectifying circuit 12 comprising a diode bridge 14, receiving voltage $V_{IN}$ and supplying a rectified voltage $V_{ALIM}$ which powers light-emitting diodes 16, for example, series-assembled with a resistor 15. Call $I_{ALIM}$ the current flowing through light-emitting diodes 16.

FIG. 2 is a timing diagram of power supply voltage $V_{ALIM}$ and of power supply current $I_{ALIM}$ for an example where AC voltage $V_{IN}$ corresponds to a sinusoidal voltage. When voltage $V_{ALIM}$ is greater than the sum of the threshold voltages of light-emitting diodes 16, light-emitting diodes 16 become conductive. Power supply current $I_{ALIM}$ then follows power supply voltage $V_{ALIM}$ There thus is an alternation of phases OFF without light emission and of light-emission phases ON.

A disadvantage is that as long as voltage $V_{ALIM}$ is smaller than the sum of the threshold voltages of light-emitting diodes 16, no light is emitted by optoelectronic circuit 10. An observer may perceive this lack of light emission when the duration of each phase OFF with no light emission between two light-emission phases ON is too long. A possibility, to increase the duration of each phase ON, is to decrease the number of light-emitting diodes 16. A disadvantage then is that the electric power lost in the resistor is significant.

Publication US 2012/0056559 describes an optoelectronic circuit where the number of light-emitting diodes receiving power supply voltage $V_{ALIM}$ progressively increases during a rising phase of the power supply voltage and progressively decreases during a falling phase of the power supply voltage. This is achieved by a switching circuit capable of short-circuiting a variable number of light-emitting diodes according to the variation of voltage $V_{ALIM}$ This enables to decrease the duration of each phase with no light emission.

A disadvantage of the optoelectronic circuit described in publication US 2012/0056559 is that the light-emitting diode power supply current does not continuously vary, that is, there are abrupt interruptions of the current flow during the voltage variation. This causes time variations of the light intensity supplied by the light-emitting diodes, which may be perceived by an observer. This further causes a degradation of the harmonic factor of the current powering the light-emitting diodes of the optoelectronic circuit.

SUMMARY

An object of an embodiment is to overcome all or part of the disadvantages of the previously-described optoelectronic circuits.

Another object of an embodiment is to decrease the duration of phases during which no light is emitted by the optoelectronic circuit.

Another object of an embodiment is for the current powering the light-emitting diodes to vary substantially continuously.

Thus, an embodiment provides an optoelectronic circuit intended to receive a variable voltage containing an alternation of rising and falling phases, the optoelectronic circuit comprising:

a plurality of assemblies of light-emitting diodes, said assemblies being series-assembled;

a current source connected to each assembly, among at least certain assemblies from the plurality of assemblies, by a switch;

for each switch, a first comparison unit capable of comparing the current flowing through the switch with a current threshold;

a second unit for comparing a voltage representative of the voltage across the current source with a voltage threshold;

a control unit connected to the first and second comparison units and capable, during each rising phase and each falling phase, of controlling the switches to the off and on state according to signals supplied by the first and second comparison units.

According to an embodiment, the control unit is capable, during each rising phase, for each switch, of controlling said switch to the off state when the current flowing through the adjacent switch in the on state rises above the current threshold and, during each falling phase, for each off switch adjacent to a switch in the on state, of controlling said switch to the on state when said voltage falls below the voltage threshold.

According to an embodiment, the current source is capable of supplying a current having its intensity depending on at least one control signal.

According to an embodiment, the current source is capable of supplying a current having its intensity varying among a plurality of different intensity values according to the number of assemblies conducting said current during at least one rising or falling phase.

According to an embodiment, the optoelectronic circuit is capable of receiving a modulation signal external to the optoelectronic circuit and the current source is capable of modifying said intensity values according to said modulation signal.

According to an embodiment, the current source comprises elementary current sources assembled in parallel and capable of being activated and deactivated independently from one another.

According to an embodiment, the elementary current sources are capable of supplying currents having the same intensity or having different intensities.

According to an embodiment, the control unit is capable of activating at least one of the elementary current sources during at least one rising phase and is capable of deactivating at least one of the elementary current sources during at least one falling phase.

According to an embodiment, one of the elementary current sources is capable of supplying a current having a given intensity and the other elementary current sources are capable of each supplying a current having an intensity equal to the product a power of two and of said given intensity.

According to an embodiment, the control unit is capable of controlling the switches to connect the assemblies of light-emitting diodes according to a plurality of connection configurations successively according to a first order during each rising phase of the variable voltage and a second order during each falling phase of the variable voltage and is capable of activating the elementary current sources according to a third order during each rising phase of the variable voltage and of deactivating the elementary current sources according to a fourth order during each rising phase of the variable voltage.

According to an embodiment, the optoelectronic circuit comprises a memory having a plurality of values of the control signal of the current source, each corresponding to the provision by the current source of a current having its intensity varying among said plurality of intensity values, stored therein.

According to an embodiment, the optoelectronic circuit comprises means for modifying the variation profile of the intensity of said current according to the number of assemblies conducting said current during at least one rising or falling phase.

Another embodiment provides a method of controlling a plurality of assemblies of light-emitting diodes, said assemblies being series-assembled and powered with a variable voltage, containing an alternation of rising and falling phases, each assembly among at least certain assemblies from the plurality of assemblies being connected to a current source by a switch, the method comprising the steps of:

for each switch, comparing the current flowing through the switch with a current threshold;

comparing a voltage representative of the voltage across the current source with a voltage threshold; and during each rising phase and each falling phase, controlling the switches to the off and on state according to signals supplied by the first and second comparison units.

According to an embodiment, the method further comprises the step of:

during each rising phase, for each switch, turning off said switch when the current flowing through the adjacent switch in the on state rises above the current threshold and, during each falling phase, for each off switch adjacent to a switch in the on state, turning on said switch when said voltage falls below the voltage threshold.

According to an embodiment, the current source comprises at least two elementary current sources assembled in parallel and at least one of the elementary current sources is activated during at least one rising phase and at least one of the elementary current sources is deactivated during at least one falling phase.

According to an embodiment, the current source comprises at least three elementary current sources assembled in parallel, wherein, for at least successive rising and falling phases, the number of activated elementary current sources increases from the beginning to the end of the rising phase and the number of activated elementary current sources decreases from the beginning to the end of the falling phase or wherein the number of activated elementary current sources increases and then decreases from the beginning to the end of the rising phase and the number of activated elementary current sources increases and then decreases from the beginning to the end of the falling phase.

BRIEF DESCRIPTION OF THE DRAWINGS

The foregoing and other features and advantages will be discussed in detail in the following non-limiting description of specific embodiments in connection with the accompanying drawings, among which.

DETAILED DESCRIPTION

Figure 1:
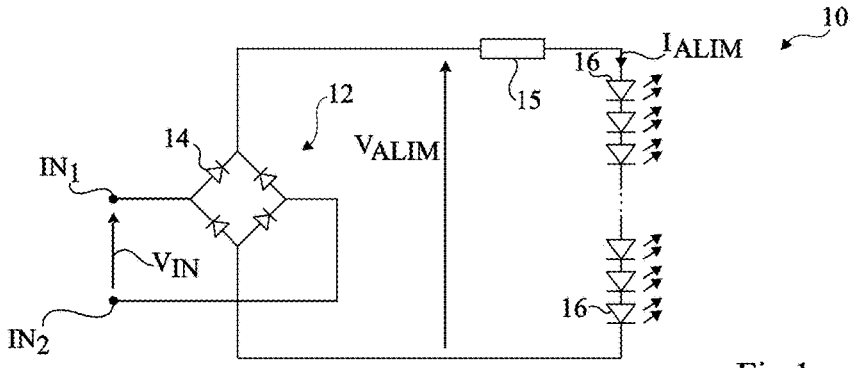
FIG. 1, previously described, is an electric diagram of an example of an optoelectronic circuit comprising light-emitting diodes.
Figure 2:
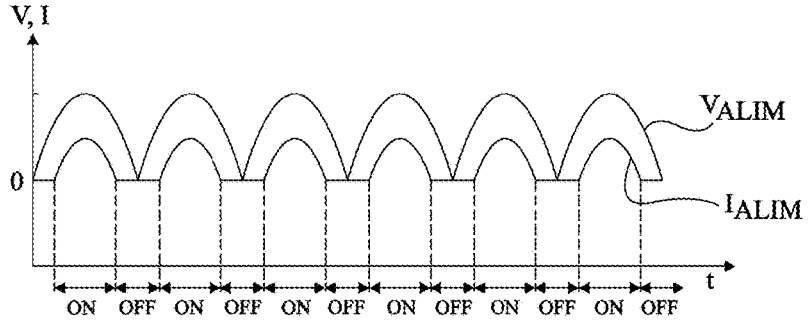
FIG. 2, previously described, is a timing diagram of the power supply voltage and current of the light-emitting diodes of the optoelectronic circuit of FIG. 1.

For clarity, the same elements have been designated with the same reference numerals in the various drawings and, further, the various drawings are not to scale. Unless otherwise specified, expressions "approximately", "substantially", and "in the order of" mean to within 10%, preferably to within 5%. In the following description, the ratio of the active power consumed by the electronic circuit to the product of the effective values of the current and of the voltage powering the electronic circuit is called "power factor".

Figure 3:
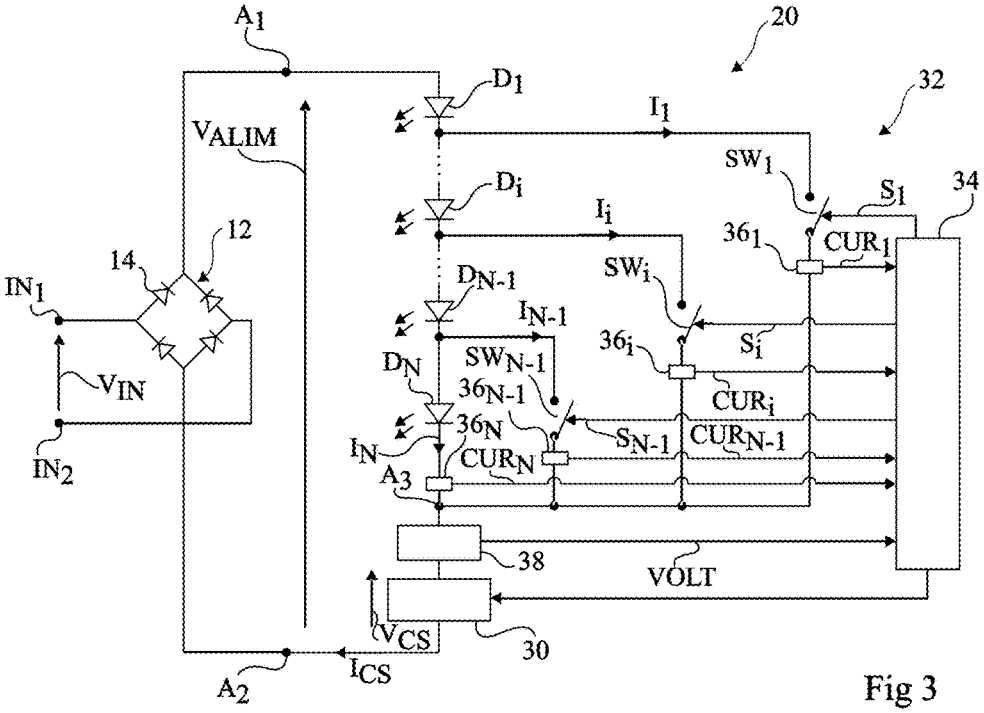
FIG. 3 shows an electric diagram of an embodiment of an optoelectronic circuit comprising light-emitting diodes.

FIG. 3 shows an electric diagram of an embodiment of an optoelectronic circuit 20 comprising a light-emitting diode switching device. The elements of optoelectronic circuit 20 common with optoelectronic circuit 10 are designated with the same reference numerals. In particular, optoelectronic circuit 20 comprises rectifying circuit 12 receiving power supply voltage $V_{IN}$ between terminals $IN_1$ and $IN_2$ and supplying rectified voltage $V_{ALIM}$ between nodes $A_1$ and $A_2$. As a variation, circuit 20 may directly receive a rectified voltage, and it is then possible for the rectifying circuit not to be present. The potential at node $A_2$ may correspond to the low reference potential having the voltages of optoelectronic circuit 20 referenced thereto.

Optoelectronic circuit 20 comprises N series-connected assemblies of elementary light-emitting diodes, called general light-emitting diodes $D_i$ in the following description, where i is an integer in the range from 1 to N and where N is an integer in the range from 2 to 200. Each general light-emitting diode $D_1$ to $D_N$ comprises at least one elementary light-emitting diode and is preferably formed of the series and/or parallel assembly of at least two elementary light-emitting diodes. In the present example, the N general light-emitting diodes $D_i$ are series-connected, the cathode of general light-emitting diode $D_i$ being coupled to the anode of general light-emitting diode $D_{i+1}$, for i varying from 1 to N−1. The anode of general light-emitting diode $D_1$ is coupled to node $A_1$. General light-emitting diodes $D_i$, with i varying from 1 to N, may comprise the same number of elementary light-emitting diodes or different numbers of elementary light-emitting diodes.

Figure 4:
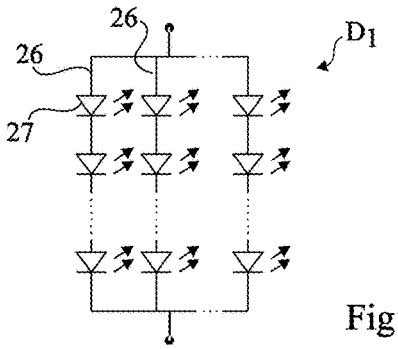
FIGS. 4 and 5 illustrate two layouts of the light-emitting diodes of the optoelectronic circuit of FIG. 3.

FIG. 4 shows an embodiment of general light-emitting diode $D_1$ where general light-emitting diode $D_1$ comprises R branches 26 assembled in parallel, each branch comprising S elementary light-emitting diodes 27 series-assembled in the same conduction direction, R and S being integers greater than or equal to 1.

Figure 5:
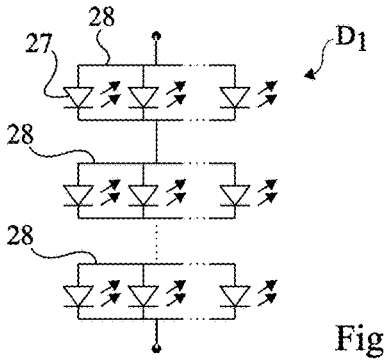

FIG. 5 shows another embodiment of general light-emitting diode $D_1$ where general light-emitting diode $D_1$ comprises P series-assembled blocks 28, each block comprising Q elementary light-emitting diodes 27 assembled in parallel, P and Q being integers greater than or equal to 1 and Q being likely to vary from one block to the other.

The other general light-emitting diodes $D_2$ to $D_N$ may have a structure similar to that of general light-emitting diode $D_1$ shown in FIG. 4 or 5.

Elementary light-emitting diodes 27 are, for example, planar light-emitting diodes, each comprising a stack of layers laid on a planar surface, having at least one active layer capable of emitting light. Elementary light-emitting diodes 27 are, for example, light-emitting diodes formed from three-dimensional semiconductor elements, particularly microwires, nanowires, or pyramids, for example comprising a semiconductor material based on a compound mainly comprising at least one group-III element and one group-V element (for example, gallium nitride GaN), called III-V general hereafter, or mainly comprising at least one group-II element and one group-VI element (for example, zinc oxide ZnO), called II-VI general hereafter. Each three-dimensional semiconductor element is covered with an active layer capable of emitting light.

Referring back to FIG. 3, optoelectronic circuit 20 comprises a current source 30 having a terminal connected to node $A_2$ and having its other terminal connected to a node $A_3$. Call $V_{CS}$ the voltage across current source 30 and $I_{CS}$ the current supplied by current source 30. Optoelectronic circuit 20 may comprise a circuit, not shown, which supplies a reference voltage to power the current source, possibly obtained from voltage $V_{ALIM}$.

Circuit 20 comprises a device 32 for switching general light-emitting diodes $D_i$, with i varying from 1 to N. As an example, device 32 comprises N−1 controllable switches $SW_1$ to $SW_{N-1}$. Each switch $SW_i$, with i varying from 1 to N−1, is assembled between node $A_3$ and the cathode of general light-emitting diode $D_i$. Each switch $SW_i$, with i varying from 1 to N−1, is controlled by a signal $S_i$ supplied by a control unit 34. For i varying from 1 to N−1, call $I_i$ the current flowing through switch $SW_i$ and call $I_N$ the current flowing through general light-emitting diode $D_N$. As a variation, a switch may further be present between the cathode of general light-emitting diode $D_N$ and node $A_3$.

According to an embodiment, current source 30 is also controlled by control unit 34. Control unit 34 may totally or partly be formed by a dedicated circuit or may comprise a microprocessor or a microcontroller capable of executing a sequence of instructions stored in a memory. As an example, signal $S_i$ is a binary signal and switch $SW_i$ is off when signal $S_i$ is in a first state, for example, the low state, noted "0", and switch $SW_i$ is on when signal $S_i$ is in a second state, for example, the high state, noted "1".

Each switch $SW_i$ is, for example, a switch comprising at least one transistor, particularly a field-effect metal-oxide gate transistor or enrichment (normally on) or depletion (normally off) MOS transistor. According to an embodiment, each switch $SW_i$ comprises a MOS transistor, for example, having an N channel, having its drain coupled to the cathode of general light-emitting diode $D_i$, having its source coupled to node $A_3$, and having its gate receiving signal $S_i$.

Optoelectronic circuit 20 comprises, for i varying from 1 to N−1, a current sensor $\mathbf{36}_i$, provided between node $A_3$ and switch $SW_i$, delivering a signal $CUR_i$ to control unit 34. Optoelectronic circuit 20 further comprises a current sensor $\mathbf{36}_N$ provided between node $A_3$ and the cathode of general light-emitting diode $D_N$ and delivering a signal $CUR_N$ to control unit 34. Further, optoelectronic circuit 20 comprises a voltage sensor 38 provided between current source 30 and node $A_3$ and delivering a signal VOLT to control unit 34.

According to an embodiment, for i varying from 1 to N, signal $CUR_i$ is representative of the intensity of current $I_i$. According to another embodiment, signal $CUR_i$ indicates whether the intensity of current $I_i$ is greater than a current threshold, where the current threshold may be the same for each current $I_i$ or may be different according to the considered current $I_i$.

According to an embodiment, signal VOLT is representative of voltage $V_{CS}$. According to another embodiment, signal VOLT indicates whether voltage $V_{CS}$ is greater than a voltage threshold. Voltage sensor 36 may then comprise an operational amplifier assembled as a comparator supplying signal VOLT, having its non-inverting input connected to node $A_3$ and having its inverting input receiving the threshold voltage.

Figure 6:
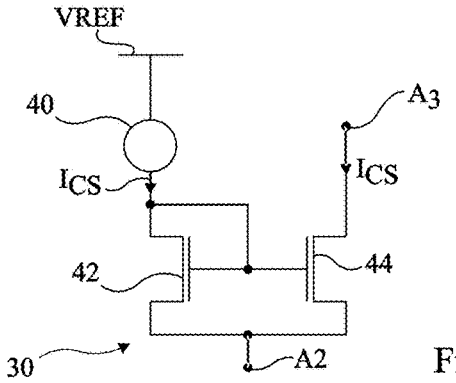
FIGS. 6 to 9 show more detailed electric diagrams of embodiments of portions of the optoelectronic circuit of FIG. 3.

FIG. 6 shows an electric diagram of a more detailed embodiment of current source 30. In the present embodiment, current source 30 comprises an ideal current source 40 having a terminal connected to a source of a high reference potential VREF. The other terminal of current source 40 is connected to the drain of a diode-assembled N-channel MOS transistor 42. The source of MOS transistor 42 is connected to node $A_2$. The gate of MOS transistor 42 is connected to the drain of MOS transistor 42. High reference potential VREF may be supplied from voltage $V_{ALIM}$ It may be constant or vary according to voltage $V_{ALIM}$ The intensity of the current supplied by current source 30 may be constant or be variable, for example, it may vary according to voltage $V_{ALIM}$. Current source 30 comprises an N-channel MOS transistor 44 having its gate connected to the gate of transistor 42 and having its source connected to node $A_2$. The drain of transistor 44 is connected to node $A_3$, while voltage sensor 38 is not shown in FIG. 6. MOS transistors 42 and 44 form a current mirror which copies current $I_{CS}$ supplied by current source 40, possibly with a multiplication factor.

Figure 7:
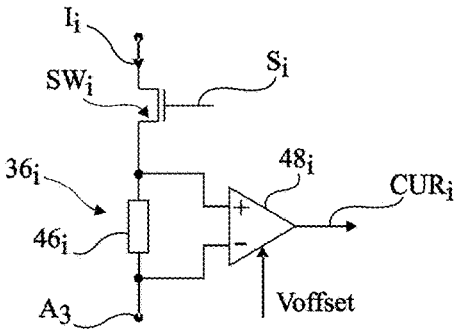

FIG. 7 shows an embodiment of current sensor $\mathbf{36}_i$ where current sensor $\mathbf{36}_i$ comprises a resistor $\mathbf{46}_i$ series-assembled between node $A_3$ and switch $SW_i$, shown in FIG. 7 as a MOS transistor, and an operational amplifier $\mathbf{48}_i$ assembled as a comparator supplying signal $CUR_i$, having its non-inverting input (+) connected to a terminal of resistor $\mathbf{46}_i$ and having its inverting input (−) connected to the other terminal of resistor $\mathbf{46}_i$. Amplifier $\mathbf{48}_i$ comprises a terminal for setting offset voltage $V_{offset}$, or reference voltage, of the amplifier. Amplifier 48$_i$ supplies signal $CUR_i$ in a first state when the voltage across resistor 46$_i$ is greater than offset voltage $V_{offset}$ and in a second state when the voltage across resistor 46$_i$ is smaller than offset voltage $V_{offset}$.

Figure 8:
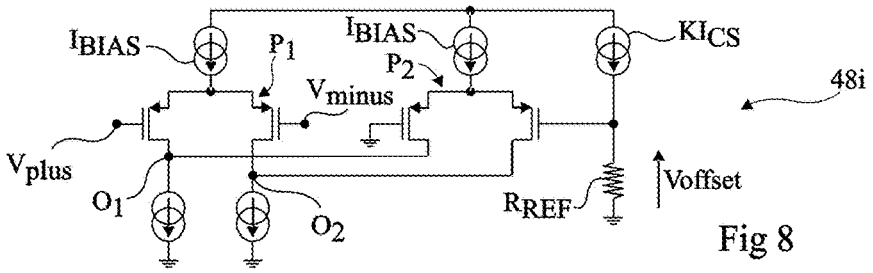

FIG. 8 shows a more detailed embodiment of comparator 48$_i$ and of a circuit supplying reference voltage $V_{offset}$. Comparator 48$_i$ comprises a first differential pair $P_1$, for example comprising two MOS transistors powered with a current $I_{BIAS}$ and which detects the current flowing through resistor 46$_i$, not shown in FIG. 8 and located between gates $V_{plus}$ and $V_{minus}$ of the transistors of pair $P_1$. Nodes $O_1$ and $O_2$ are connected to the drains of the transistors of pair $P_1$. Comparator 48$_i$ comprises a second differential pair $P_2$, for example comprising two MOS transistors supplied with a current $I_{BIAS}$ and which outputs reference voltage $V_{offset}$ Nodes $O_1$ and $O_2$ are further connected to the drains of the transistors of pair $P_2$. Reference voltage $V_{offset}$ is proportional to a bias current $KI_{CS}$, which is an image of the current $I_{CS}$ supplied by current source 30, to the resistance of resistor $R_{REF}$ having conducted the previous current, and to the transconductance ratio of the different pairs. An amplifier output stage connected to nodes $O_1$ and $O_2$ delivers a signal at a state "1" or "0" according to the sign of the voltage between nodes $O_1$ and $O_2$.

According to another embodiment, the current sensor may comprise a current mirror. Only a small fraction of the current flowing through switch $SW_i$ is then branched towards a current comparator.

Figure 9:
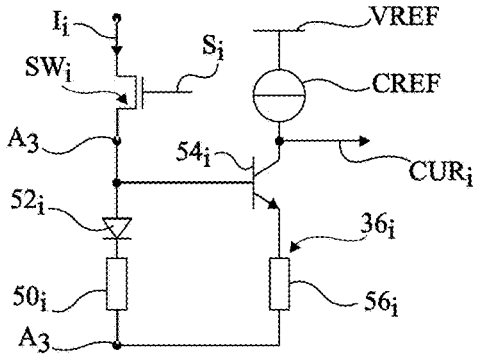

FIG. 9 shows another embodiment of current sensor 36$_i$, where current sensor 36$_i$ comprises a resistor 50$_i$ and a diode 52$_i$ series-assembled between node $A_3$ and switch $SW_i$, shown in FIG. 9 as a MOS transistor, the cathode of diode 52$_i$ being connected to resistor 50$_i$. Current sensor 36$_i$ further comprises a bipolar transistor 54$_i$ having its base connected to the anode of diode 52$_i$, having its collector supplying signal $CUR_i$, and having its emitter connected to node $A_3$ by a resistor 56$_i$. The collector of bipolar transistor 54$_i$ is connected to a terminal of a source of a reference current CREF having its other terminal connected to the source of reference voltage VREF.

Advantageously, the maximum voltages applied to the electronic components, particularly the MOS transistors, of current sensors 36$_i$ and of voltage sensor 38 remain small as compared with the maximum value that voltage $V_{ALIM}$ can take. It is then not necessary to provide, for current sensors 36$_i$ and current sensor 38, electronic components capable of withstanding the maximum voltage that voltage $V_{ALIM}$ can take.

Optoelectronic circuit 20 operates as follows. At the beginning of a rising phase of voltage $V_{ALIM}$, switches $SW_i$, with i varying from 1 to N−1, are on, that is, electrically conductive. In a rising phase, for i varying from 1 to N−1, while general light-emitting diodes $D_1$ to $D_{i-1}$ are conductive and general light-emitting diodes $D_i$ to $D_N$ are non-conductive, when the voltage across general light-emitting diode $D_i$ becomes greater than the threshold voltage of general light-emitting diode $D_i$, the latter becomes conductive and a current starts flowing through general light-emitting diode $D_i$. The flowing of the current is detected by current sensor 36$_i$. Unit 34 then controls switch $SW_{i-1}$ to the off state. At the beginning of a falling phase of power supply voltage $V_{ALIM}$, switches $SW_i$, with i varying from 1 to N−1, are off. In a falling phase, general light-emitting diodes $D_1$ to $D_{i-1}$ being conductive and general light-emitting diodes $D_i$ to $D_N$ being non-conductive, when voltage $V_{CS}$ decreases below a voltage threshold, this means that the voltage across current source 30 risks being too low for the latter to operate properly and to deliver its nominal current. This thus means that the number of conducting diodes $D_i$ should be decreased to increase the voltage across the current source. The decrease of voltage $V_{CS}$ is detected by sensor 38 and switch $SW_{i-1}$ is then turned on. In the case where each switch $SW_i$ is made of an N-channel MOS transistor having its drain coupled to the cathode of general light-emitting diode $D_i$ and having its source connected to current sensor 36$_i$, when power supply voltage $V_{ALIM}$ decreases, the voltage between the drain of switch $SW_i$ and node $A_2$ decreases until the operation of transistor $SW_i$ switches from the saturation state to the linear state. This causes an increase of the voltage between the gate and the source of transistor $SW_i$ and thus a decrease of voltage $V_{CS}$. When voltage $V_{CS}$ decreases below the voltage threshold, switch $SW_{i-1}$ is turned on.

Advantageously, the embodiment of the previously-described method of controlling switches $SW_i$ does not depend on the number of elementary light-emitting diodes which form each general light-emitting diode $D_i$ and thus does not depend on the threshold voltage of each general light-emitting diode.

Figure 10:
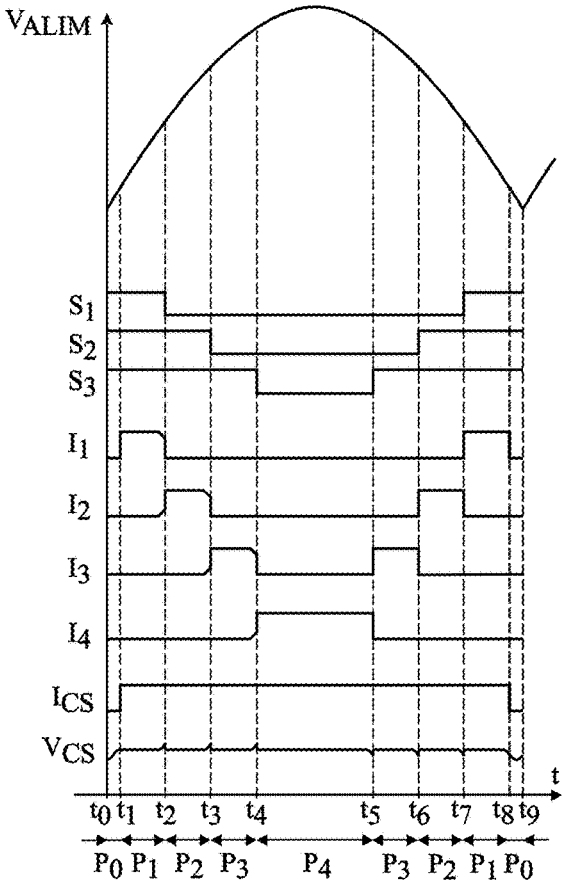
FIG. 10 is a timing diagram of voltages and of currents of the optoelectronic circuit of FIG. 3.

FIG. 10 shows timing diagrams of power supply voltage $V_{ALIM}$, of signals $S_i$, with i varying from 1 to N−1, of currents $I_i$, with i varying from 1 to N, of current $I_{CS}$, and of voltages $V_{CS}$ illustrating the operation of optoelectronic circuit 20 according to the embodiment shown in FIG. 3, in the case where N is equal to 4 and in the case where each general light-emitting diode $D_i$ comprises the same number of elementary light-emitting diodes arranged in the same configuration, and thus has the same threshold voltage Vled and in the case where current source 30 supplies a constant current $I_{CS}$. Call $t_0$ to $t_9$ successive times.

At time $t_0$, at the beginning of a cycle, all switches $SW_i$, with i varying from 1 to N−1, are on (signals $S_i$ at "1"). Voltage $V_{ALIM}$ rises from the zero value. Voltage $V_{ALIM}$ being smaller than threshold voltage Vled of general light-emitting diode $D_1$, there is no light emission (phase $P_0$). Current $I_{CS}$ is equal to zero.

At time $t_1$, when the voltage across general light-emitting diode $D_1$ exceeds threshold voltage Vled, general light-emitting diode $D_1$ becomes conductive (phase $P_1$) and the voltage across general light-emitting diode $D_1$ then remains substantially constant and equal to Vled. As soon as voltage $V_{CS}$ is sufficiently high to allow the activation of current source 30, current $I_{CS}$ flows through the general light-emitting diode $D_1$, which emits light. Current $I_{CS}$ entirely flow through the branch comprising switch $SW_1$ and current $I_1$ is equal to $I_{CS}$. As an example, voltage $V_{CS}$ is preferably substantially constant when current source 30 is in operation. In FIG. 10, it has been assumed that current source 30 is activated before general light-emitting diode $D_1$ becomes conductive so that current $I_{CS}$ flows through general light-emitting diode $D_1$ from as soon as time $t_1$.

During the increase of voltage $V_{ALIM}$, when the voltage across general light-emitting diode $D_2$ exceeds threshold voltage Vled, general light-emitting diode $D_2$ becomes conductive and current $I_{CS}$ is distributed between the branch containing switch $SW_1$ and the branch containing switch $SW_2$. A slight temporary increase of voltage $V_{CS}$ can then be observed. Current $I_1$ decreases and current $I_2$ increases. When, at time $t_2$, current $I_2$ exceeds the current threshold, unit 34 controls switch $SW_1$ to the off state (signal S1 set to "0"). Current $I_1$ becomes equal to zero and current $I_2$ increases up to $I_{CS}$. Phase $P_2$ corresponds to a phase of light emission by general light-emitting diodes $D_1$ and $D_2$.

Generally, during a rising phase of power supply voltage $V_{ALIM}$, for i varying from 1 to N−1, while switches $SW_1$ to $SW_{i-1}$ are off and switches $SW_i$ to $SW_{N-1}$ are on, unit 34 controls switch $SW_i$ to the off state when current $I_{i+1}$ flowing through the branch containing switch $SW_{i+1}$ exceeds the current threshold. Phase $P_{i+1}$ corresponds to the emission of light by general light-emitting diodes $D_1$ to $D_{i+1}$.

Thus, at time $t_3$, unit 34 controls switch $SW_2$ to the off state by the setting to "0" of signal $S_2$ and at time $t_4$, unit 34 controls switch $SW_3$ to the off state by the setting to "0" of signal $S_3$.

Power supply voltage $V_{ALIM}$ reaches its maximum value during phase $P_4$ and starts a falling phase.

At time $t_5$, during the decrease of voltage $V_{ALIM}$, voltage $V_{CS}$ decreases below the voltage threshold, unit 34 then controls switch $SW_3$ to the on state by the setting to "1" of signal $S_3$. Current $I_{CS}$ then entirely flows through the branch containing switch $SW_3$. Current $I_4$ thus takes a zero value and current $I_3$ becomes equal to $I_{CS}$.

Generally, during a falling phase of power supply voltage $V_{ALIM}$, for i varying from 1 to N−1, while switches $SW_1$ to $SW_{i-1}$ are off and switches $SW_i$ to $SW_{N-1}$ are on, when voltage $V_{CS}$ decreases below the voltage threshold, unit 34 controls switch $SW_{i-1}$ to the on state.

Thus, at time $t_6$, unit 34 controls switch $SW_2$ to the on state by the setting to "1" of signal $S_2$ and, at time $t_7$, unit 34 controls switch $SW_1$ to the on state by the setting to "1" of signal $S_1$.

At time $t_8$, the voltage across general light-emitting diode $D_1$ falls below voltage Vled. General light-emitting diode $D_1$ is then no longer conductive and current $I_1$ falls to zero.

At time $t_9$, voltage $V_{ALIM}$ becomes equal to zero, which ends the cycle.

In the previously-described embodiments, in a rising phase, when light-emitting diode $D_{i+1}$ becomes conductive while light-emitting diode $D_i$ is already conducting and switch $SW_i$ is still on, the current is distributed in the branch comprising light-emitting diode $D_{i+1}$ and the branch comprising light-emitting diode $D_i$. A temporary slight increase of voltage $V_{CS}$, not shown in the drawings, can then be observed. When switch $SW_i$ is off, current $I_{CS}$ entirely flows through the branch comprising light-emitting diode $D_{i+1}$. A temporary slight increase of voltage $V_{CS}$ can then be observed. However, this decrease should not be detected by comparator 38 and cause the turning on of switch $SW_i$ by control unit 34. According to an embodiment, the optoelectronic circuit is sized, particularly by an adapted selection of the detection threshold of comparison unit 38 and of the properties of switches $S_i$ and of the assemblies of light-emitting diodes $D_i$, so that the temporary decrease of voltage $V_{CS}$ is sufficiently small not to be detected by comparison unit 38. According to another embodiment, control unit 34 is capable of not taking into account a detection of a decrease of voltage $V_{CS}$ by comparison unit 38 during a rising phase of voltage $V_{ALIM}$. This may be achieved by a temporary deactivation of comparison unit 38 for each rising phase or for a determined time period after each turning off of a switch $SW_i$.

According to an embodiment, current source 30 is a current source controlled by control unit 34 and capable of supplying a current $I_{CS}$ which remains uninterrupted as long as power supply voltage $V_{ALIM}$ is greater than the threshold voltage of general light-emitting diode $D_1$. According to an embodiment, current source 30 is capable of supplying a variable current at different levels according to the number of general light-emitting diodes which are conductive.

Figure 11:
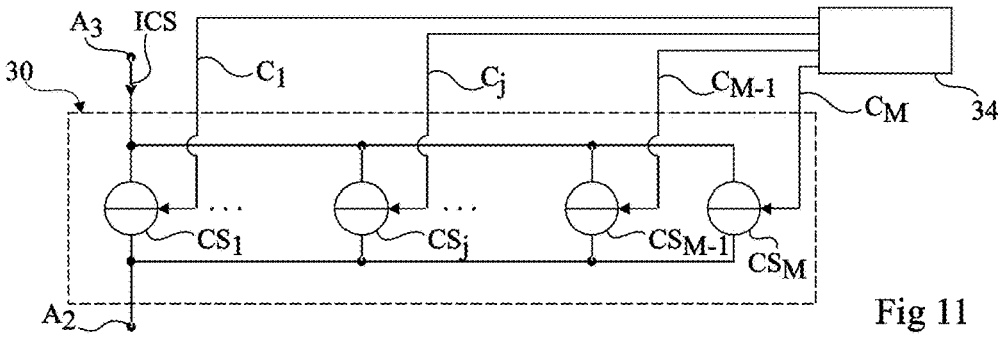
FIG. 11 shows an electric diagram of another embodiment of the current source of the optoelectronic circuit of FIG. 3.

FIG. 11 shows an embodiment of current source 30 where current source 30 comprises M elementary controllable current sources $CS_1$ to $CS_M$, M being an integer capable of varying from 1 to N. Preferably, M is equal to N. In the present embodiment, elementary current sources $CS_j$, with j varying from 1 to M, are assembled in parallel between node $A_3$ and node $A_2$. Each elementary current source $CS_j$ is activated or deactivated by control unit 34 by means of a control signal $C_j$. As an example, signal $C_j$ is a binary signal and elementary current source $CS_j$ is off when signal $C_j$ is in a first state, for example, the low state, and current source $CS_j$ is activated when signal $C_j$ is in a second state, for example, the high state. As a variation, signal $C_1$ may be omitted and current source $CS_1$ may be automatically activated, that is, it supplies a current as soon as it is powered with a sufficient voltage.

The larger the number of current sources $CS_j$ which are activated, the higher the intensity of current $I_{CS}$. According to an embodiment, the number of elementary current sources $CS_j$ which are activated depends on the number of general light-emitting diodes $D_i$ which are conductive. According to an embodiment, current source 30 is capable of supplying a current $I_{CS}$ having an intensity at a level among a plurality of constant levels and having its level depending on the number of general light-emitting diodes which are conductive. The currents supplied by elementary current sources $CS_j$ of current source 30 may be identical or different. According to an embodiment, each elementary current source $CS_j$ is capable of supplying a current of intensity $I*2^{j-1}$. Current source 30 is then capable of supplying a current having an intensity $I_{CS}$ which may, according to control signals $C_j$, take any value k*I, with k varying from 0 to $2^M-1$.

The sequence of activation of current sources $CS_j$ during the variation of voltage $V_{ALIM}$ particularly depends on the operating properties of the optoelectronic circuit which are desired to be favored.

Figure 12A:
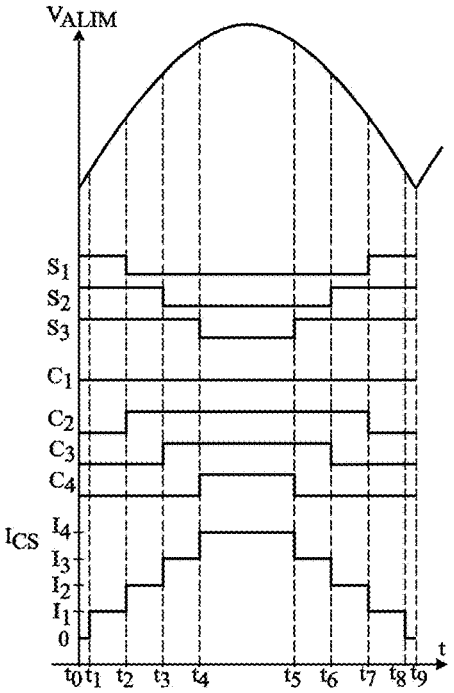
FIGS. 12A and 12B are timing diagrams of voltages and of currents of the optoelectronic circuit of FIG. 3 for two embodiments of a method of controlling the current source of the optoelectronic circuit.

FIG. 12A illustrates an embodiment of a sequence of activation of the current sources which enables to increase the power factor of the optoelectronic circuit as compared with the case where the current would be constant. FIG. 12A shows curves of the variation of signals $S_1$, $S_2$ and $S_3$, curves of the variations of signals $C_1$, $C_2$, $C_3$ and $C_4$, and of current $I_{CS}$ when optoelectronic circuit 20 comprises four general light-emitting diodes and four elementary current sources $CS_j$ in parallel, during a cycle of voltage $V_{ALIM}$ in the case where voltage $V_{IN}$ is a sinusoidal voltage. The control of signals $S_1$, $S_2$ and $S_3$ is identical to what has been previously described in relation with FIG. 10 and $I_1$, $I_2$, $I_3$ and $I_4$ are increasing intensity values of current $I_{CS}$.

According to an embodiment, at the beginning of a rising phase of voltage $V_{ALIM}$, signals $S_i$, with i varying from 1 to N−1, are initially at "1" so that switches $SW_i$ are on. Signal $C_1$ is at "1" so that current source $CS_1$ is activated. At time $t_1$, general light-emitting diode $D_1$ turns on and conducts current $I_{CS}$ having an intensity equal to $I_1$. Switches $SW_1$, $SW_2$, and $SW_3$ are successively turned off at times $t_1$, $t_2$, and $t_3$ along the rise of voltage $V_{ALIM}$ so that general light-emitting diodes $D_2$, $D_3$, and $D_4$ are successively powered with current. In parallel, current sources $CS_2$, $CS_3$ and $CS_4$ are successively activated at times $t_2$, $t_3$, and $t_4$ along the rise of voltage $V_{ALIM}$, so that the intensity of power supply current $I_{CS}$ is successively equal to $I_2$, $I_3$ and $I_4$. During a falling phase of voltage $V_{ALIM}$, switches $SW_3$, $SW_2$, and $SW_1$ are successively turned on at times $t_5$, $t_6$, and $t_7$ to successively short-circuit general light-emitting diodes $D_4$, $D_3$, and $D_2$. In parallel, during a falling phase of voltage $V_{ALIM}$, current sources $CS_4$, $CS_3$ and $CS_2$ are successively deactivated at times $t_5$, $t_6$, and $t_7$ so that the intensity of power supply current $I_{CS}$ is successively equal to $I_3$, $I_2$ and $I_1$. At time $t_8$, when the power supply voltage becomes smaller than the threshold voltage of general light-emitting diode $D_1$, current $I_{CS}$ takes a zero value.

In this embodiment, the current sources are activated so that power supply current $I_{CS}$ follows as best as possible the general shape of a sine wave, that is, the shape of voltage $V_{ALIM}$, in phase therewith. Advantageously, the power factor of the optoelectronic circuit is then increased.

Figure 12B:
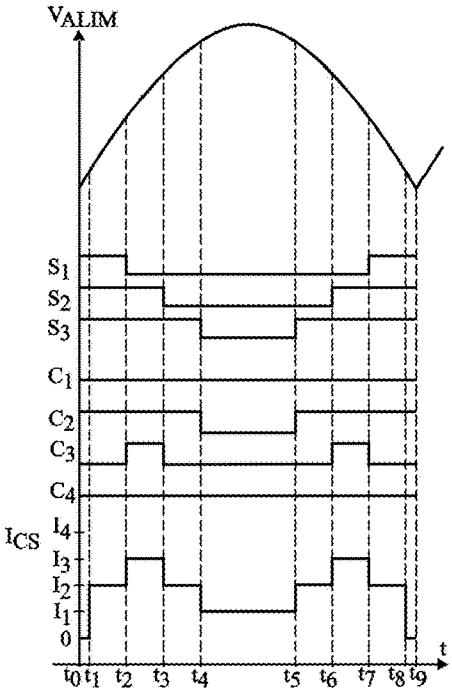

FIG. 12B is similar to FIG. 12A and illustrates an embodiment of a sequence of activation of the current sources, which enables to decrease the flickering perceived by an observer. The curves of FIG. 12B have been obtained with the optoelectronic circuit used to obtain the curves of FIG. 12A, with the difference that the current source activation sequence is modified. Indeed, signals $C_1$ and $C_2$ are initially at "1" and signals $C_3$ and $C_4$ are initially at "0" so that current sources $CS_1$ and $CS_2$ are activated and, at time $t_1$, the intensity of current $I_{CS}$ flowing through general light-emitting diode $D_1$ is equal to $I_2$. At time $t_2$, signal $C_3$ is set to "1" so that the intensity of current $I_{CS}$ flowing through general light-emitting diodes $D_1$ and $D_2$ is equal to $I_3$. At time $t_3$, signal $C_3$ is set to "0" so that the intensity of current $I_{CS}$ flowing through general light-emitting diodes $D_1$, $D_2$, and $D_3$ is equal to $I_2$. At time $t_4$, signal $C_2$ is set to "0" so that the intensity of current $I_{CS}$ flowing through general light-emitting diodes $D_1$, $D_2$, $D_3$, and $D_4$ is equal to $I_1$. A symmetrical activation sequence is carried out at times $t_5$, $t_6$, $t_7$, and $t_8$. The intensity of the current is controlled so that the emission light power of the optoelectronic circuit is close to the average light power emitted over a halfwave of voltage $V_{ALIM}$ The variations of the light power perceived by the observed are then decreased.

According to an embodiment, the values of control signals $C_j$ may be stored in a memory of control unit 34 for each switching configuration of the switches.

According to another embodiment, the control of current source 30 by control unit 34 may be modified during the operation of the optoelectronic circuit, for example, according to whether it is desirable to increase the power factor of the optoelectronic circuit or to decrease the flickering perceived by an observer. In the case where current source 30 comprises elementary current sources $CS_j$, this means that the sequence of activation of elementary current sources $CS_j$ may be modified during the operation of the optoelectronic circuit. As an example, the optoelectronic circuit may be made in the form of an integrated circuit comprising a dedicated pin having a control signal of control unit 34 representative of the desired control of current source 30 applied thereto. According to another example, control unit 34 comprises a memory programmable by a user, having data used by control unit 34 for the desired control of current source 30 by control unit 34 stored therein.

Figure 13:
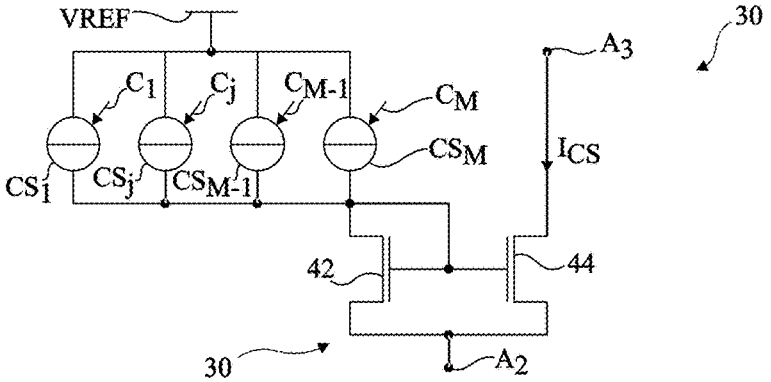
FIGS. 13 to 17 show electric diagrams of other embodiments of the current source of the optoelectronic circuit of FIG. 3.

FIG. 13 shows an electric diagram of another embodiment of current source 30. In the present embodiment, current source 30 comprises transistors 42 and 44 forming the current mirror previously described in relation with FIG. 6. Current source 30 further comprises current sources $CS_1$ to $CS_M$ which are assembled in parallel between a source of reference voltage VREF and the drain of transistor 42.

Figure 14:
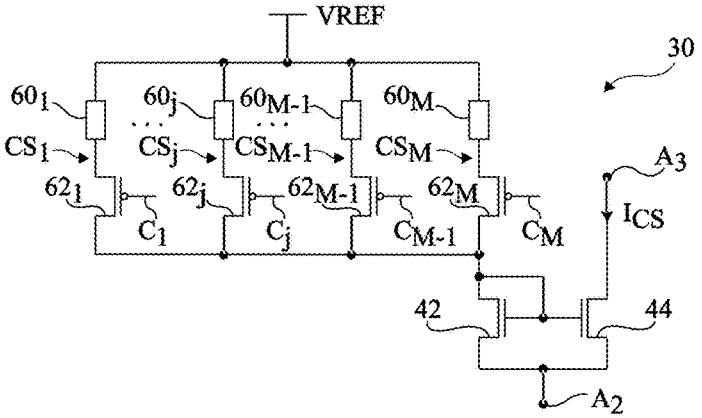

FIG. 14 shows an electric diagram of another embodiment of current source 30 where current source 30 comprises the same elements as the embodiment shown in FIG. 13 and where each current source $CS_j$, with j varying from 1 to M, comprises a resistor $\mathbf{60}_j$ series-assembled with a MOS transistor $\mathbf{62}_j$, for example, with a P channel, between the source of reference potential VREF and the drain of transistor 42. The gate of each transistor $\mathbf{62}_j$ receives control signal $C_j$. Preferably, each transistor $\mathbf{62}_j$ is located on the side of transistor 42 while each resistor $\mathbf{60}_j$ is located on the side of the source of reference voltage VREF.

Figure 15:
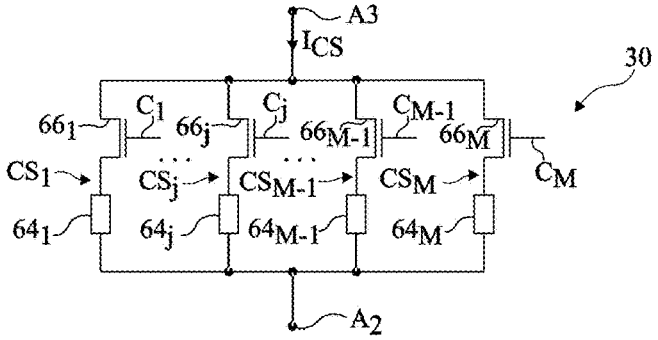

FIG. 15 shows an electric diagram of another embodiment of current source 30 where current source 30 comprises the same elements as the embodiment shown in FIG. 11 and where each current source $CS_j$, with j varying from 1 to M, comprises a resistor $\mathbf{64}_j$ series-assembled with a MOS transistor $\mathbf{66}_j$, for example, with an N channel, between node $A_3$ and node $A_2$. The gate of each transistor $\mathbf{66}_j$ receives control signal $C_j$. Each transistor $\mathbf{66}_j$ is preferably located on the side of node $A_3$ while each resistor $\mathbf{64}_j$ is preferably located on the side of node $A_2$.

Figure 16:
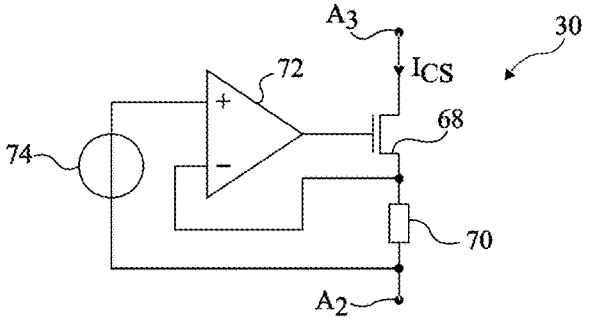

FIG. 16 shows an electric diagram of another embodiment of current source 30 where current source 30 comprises a MOS transistor 68, for example, with an N channel, having its drain connected to node $A_3$ and having its source connected to a terminal of a resistor 70, the other terminal of resistor 70 being connected to node $A_2$. Current source 30 comprises an operational amplifier 72 having its non-inverting input (+) connected to a terminal of a voltage source 74 controlled by control unit 34 and having its inverting input (−) connected to the junction point of transistor 68 and of resistor 70. The other terminal of voltage source 74 is connected to node $A_2$. The output of operational amplifier 72 is connected to the gate of transistor 68.

Figure 17:
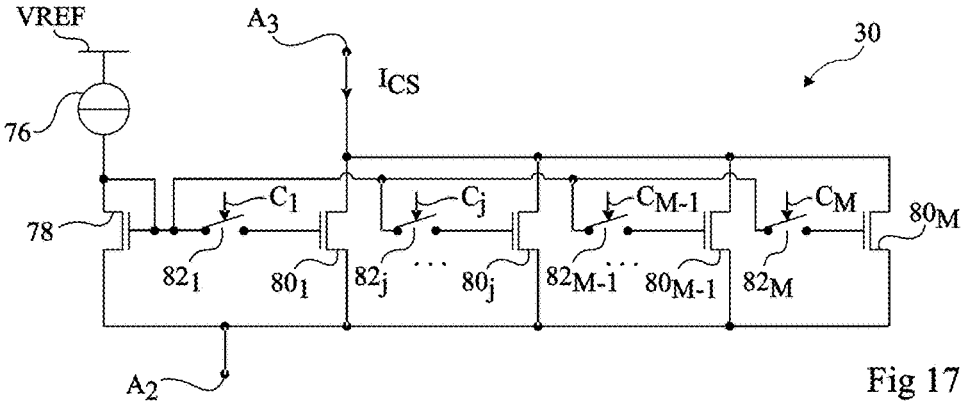

FIG. 17 shows an electric diagram of another embodiment of current source 30 where current source 30 comprises a current source 76 having a terminal connected to the source of reference potential VREF. The other terminal of current source 76 is connected to the drain of a diode-assembled MOS transistor 78, for example, having an N channel. The source of MOS transistor 78 is connected to node $A_2$. The gate of MOS transistor 78 is connected to the drain of MOS transistor 78. Current source 30 further comprises M MOS transistors $\mathbf{80}_j$, with j varying from 1 to M, for example, having an N channel. The source of each transistor $\mathbf{80}_j$ is connected to node $A_2$. The drain of each transistor $\mathbf{80}_j$ is connected to node $A_3$. The gate of each transistor $\mathbf{80}_j$ is connected to the gate of transistor 78 via a switch $\mathbf{82}_j$. Each switch $\mathbf{82}_j$ is controlled by control signal $C_i$ supplied by control unit 34. As a variation, switch $\mathbf{82}_1$ may be omitted. Each transistor $\mathbf{80}_j$ forms a current mirror with transistor 78. The intensity of current $I_{CS}$ depends on the number of switches $\mathbf{82}_j$ which are on. According to an embodiment, each transistor $\mathbf{80}_j$ is identical to transistor 78. When switch $\mathbf{82}_j$ is on, transistor $\mathbf{80}_j$ conducts a current having the same intensity as the current supplied by current source 76 and is equivalent to elementary current source $CS_j$. According to another embodiment, the dimensions of transistors $\mathbf{80}_j$ may be different from those of transistor 78 and may be different between transistors $\mathbf{80}_j$ so that the intensity of the current flowing through each transistor $\mathbf{80}_j$, when the associated switch $\mathbf{82}_j$ is on, is different from the intensity of the current supplied by current source 76. As an example, the intensity of the current flowing through each transistor $\mathbf{80}_i$, when the associated switch $\mathbf{82}_j$ is on, is equal to the product of a different power of two and of a reference intensity.

Figure 18:
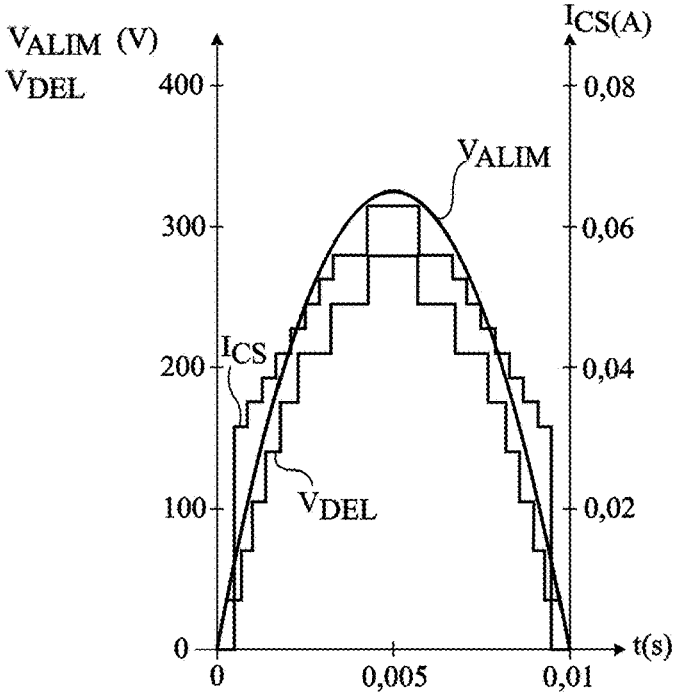
FIGS. 18 and 19 show curves of the variation, obtained by simulation, of voltages and of currents of the optoelectronic circuit of FIG. 3 for two embodiments of the method of controlling the current source of the optoelectronic circuit.
Figure 19:
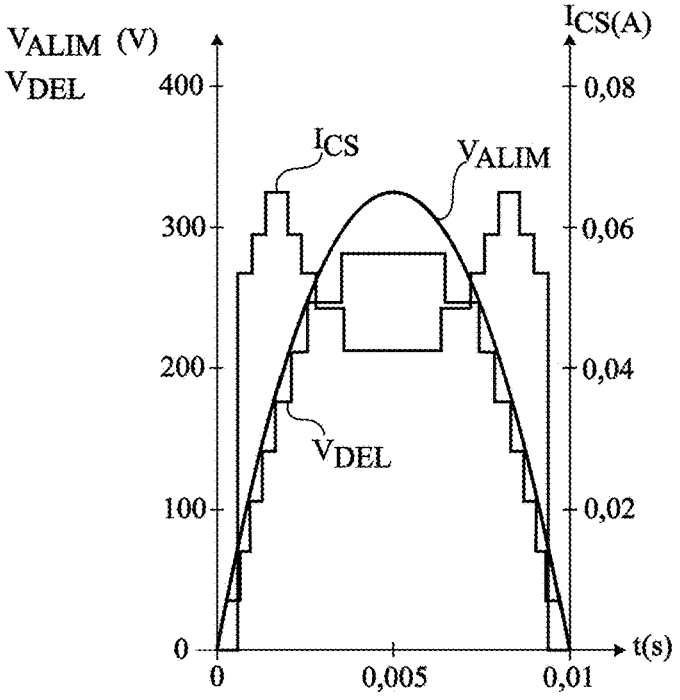

FIGS. 18 and 19 show curves of the variation, obtained by simulation during a cycle of voltage $V_{ALIM}$ in the case where voltage $V_{IN}$ is a sinusoidal voltage, of power supply voltage $V_{ALIM}$, of current $I_{CS}$, and of a voltage $V_{DEL}$ equal to the sum of the voltages across the general light-emitting diodes which are conductive, when optoelectronic circuit 20 comprises eight general light-emitting diodes and eight elementary light-emitting diodes $CS_j$ in parallel. Each elementary current source $CS_j$ is capable of supplying a constant current of same intensity.

Calling $P_{lum}$ the instantaneous light power supplied by the optoelectronic circuit and $P_{lumMOY}$ the average of the light power over a cycle of voltage $V_{ALIM}$, flicker index FI is defined by the following relation (1):

$$FI = \frac{\int_{cycle} (P_{lum}(t) - P_{lumMOY})dt}{\int_{cycle} P_{lum} dt} \quad (1)$$

FIG. 18 has been obtained with a sequence of activation of the elementary current sources of current source 30 similar to what has been previously described in relation with FIG. 12A. The average active power consumed by the optoelectronic circuit is 10.55 W, the power factor is 0.99, and flicker index FI is substantially equal to 33. The power factor is substantially equal to 1. Advantageously, the optoelectronic circuit further fulfills the constraints relative to harmonic currents provided for class-D and class-C lighting equipment by standard NF EN 61000-3-2, November 2014 version, regarding electromagnetic compatibility.

FIG. 19 has been obtained for a sequence of activation of the elementary current sources of current source 30 similar to what has been previously described in relation with FIG. 12B. The average active power consumed by the optoelectronic circuit is 10.58 W, the power factor is substantially equal to 0.89, and flicker index FI is substantially equal to 22. The flicker index is decreased with respect to the case illustrated in FIG. 18. The optoelectronic circuit further fulfills the constraints relative to harmonic currents provided for class-D lighting equipment, that is, equipment receiving an active power smaller than 25 W, by standard NF EN 61000-3-2, November 2014 version, regarding electromagnetic compatibility.

According to an embodiment, the optoelectronic circuit is capable of receiving a modulation signal external to the optoelectronic circuit and current source 30 can modify the intensity values of current $I_{CS}$ according to the modulation signal. As an example, the optoelectronic circuit may comprise a terminal dedicated to receiving the modulation signal. The modulation signal can be received by control unit 34 which accordingly controls current source 30. The modulation signal may correspond to a voltage. Current source 30 is capable of modulating each intensity value between 0% and 100% according to the modulation signal. According to an embodiment, the modulation signal may be provided by a dimmer, particularly a dimmer capable of being actuated by a user. The modulation of the intensity values may be static, dynamic, and digital, or dynamic and analog. According to another embodiment, the modulation signal may be supplied by a luminosity sensor and control unit 34 may control current source 30 to modulate the current intensity values, for example, to take into account variations of the ambient luminosity and/or variations of the light emitted by the general light-emitting diodes according to temperature. Preferably, the modulation due to the modulation signal holds the priority and the modulation rate is the same for each intensity value of current $I_{CS}$ supplied by current source 30.

Various embodiments with various variations have been described hereabove. It should be noted that those skilled in the art may combine these various embodiments and variations without showing any inventive step. In particular, each embodiment of current source 30 previously described in relation with FIGS. 13 to 17 may be used for the implementation of the embodiments of the current source control methods previously described in relation with FIGS. 12A and 12B.

The invention claimed is:

1. An optoelectronic circuit intended to receive a variable voltage containing an alternation of rising and falling phases, the optoelectronic circuit comprising:

a plurality of assemblies of light-emitting diodes, said assemblies being series-assembled;

a current source connected to each assembly, among at least certain assemblies from the plurality of assemblies, by a switch;

for each switch, a first comparison unit configured to compare the current flowing through the switch with a current threshold;

a second unit for comparing a voltage representative of the voltage across the current source with a voltage threshold; and a control unit connected to the first and second comparison units and configured to, during each rising phase and each falling phase, control the switches to the off and on state according to signals supplied by the first and second comparison units.

2. The optoelectronic circuit of claim 1, wherein the control unit is capable, during each rising phase, for each switch, of controlling said switch to the off state when the current flowing through the adjacent switch in the on state rises above the current threshold and, during each falling phase, for each off switch adjacent to a switch in the on state, of controlling said switch to the on state when said voltage falls below the voltage threshold.

3. The optoelectronic circuit of claim 1, wherein the current source is configured to supply a current having its intensity depending on at least one control signal.

4. The optoelectronic circuit of claim 3, wherein the current source is configured to supply a current having its intensity varying among a plurality of different intensity values according to the number of assemblies conducting said current during at least one rising or falling phase.

5. The optoelectronic circuit of claim 4, wherein the optoelectronic circuit is configured to receive a modulation signal external to the optoelectronic circuit and the current source is configured to modify said intensity values according to said modulation signal.

6. The optoelectronic circuit of claim 4, comprising a memory having a plurality of values of the control signal of the current source, each corresponding to the provision by the current source of said current having its intensity varying among said plurality of intensity values, stored therein.

7. The optoelectronic circuit of claim 4, comprising means for modifying the variation profile of the intensity of said current according to the number of assemblies conducting said current during at least one rising or falling phase.

8. The optoelectronic circuit of claim 1, wherein the current source comprises elementary current sources assembled in parallel and configured to be activated and deactivated independently from one another.

9. The optoelectronic circuit of claim 8, wherein the elementary current sources are configured to supply currents having the same intensity or having different intensities.

10. The optoelectronic circuit of claim 8, wherein the control unit is configured to activate at least one of the elementary current sources during at least one rising phase and is configured to deactivate at least one of the elementary current sources during at least one falling phase.

11. The optoelectronic circuit of claim 8, wherein one of the elementary current sources is configured to supply a current having a given intensity and the other elementary current sources are each configured to supply a current having an intensity equal to the product of a power of two and of said given intensity.

12. The optoelectronic circuit of claim 8, wherein the control unit is configured to control the switches to connect the assemblies of light-emitting diodes according to a plurality of connection configurations successively according to a first order during each rising phase of the variable voltage and a second order during each falling phase of the variable voltage and is configured to activate the elementary current sources according to a third order during each rising phase of the variable voltage and of deactivating the elementary current sources according to a fourth order during each falling phase of the variable voltage.

13. A method comprising:

in a circuit comprising a plurality of assemblies of light-emitting diodes, said assemblies being series-assembled and powered with a variable voltage, containing an alternation of rising and falling phases, each assembly among at least certain assemblies from the plurality of assemblies being connected to a current source by a switch:

for each switch, performing a first comparison of the current flowing through the switch with a current threshold;

performing a second comparison of a voltage representative of the voltage across the current source with a voltage threshold; and during each rising phase and each falling phase, controlling the switches to the off and on state according to the first and second comparisons.

14. The method of claim 13, further comprising the step of:

during each rising phase, for each switch, turning off said switch when the current flowing through the adjacent switch in the on state rises above the current threshold and, during each falling phase, for each off switch adjacent to a switch in the on state, turning on said switch when said voltage rises above the voltage threshold.

15. The method of claim 13, wherein the current source comprises at least two elementary current sources assembled in parallel and wherein at least one of the elementary current sources is activated during at least one rising phase and at least one of the elementary current sources is deactivated during at least one falling phase.

16. The method of claim 15, wherein the current source comprises at least three elementary current sources assembled in parallel, wherein, for at least successive rising and falling phases, the number of activated elementary current sources increases from the beginning to the end of the rising phase and the number of activated elementary current sources decreases from the beginning to the end of the falling phase or wherein the number of activated elementary current sources increases and then decreases from the beginning to the end of the rising phase and the number of activated elementary current sources increases and then decreases from the beginning to the end of the falling phase.

* * * * *